US007120979B1

(12) United States Patent
Glover

(10) Patent No.: US 7,120,979 B1
(45) Date of Patent: Oct. 17, 2006

(54) LIGHT BULB SOCKET BURNISHING TOOL

(76) Inventor: William T. Glover, 1775 E. Buck Ridge Pl., Oro Valley, AZ (US) 85737

( * ) Notice: Subject to any disclaimer, the term of this patent is extended or adjusted under 35 U.S.C. 154(b) by 108 days.

(21) Appl. No.: 10/827,674

(22) Filed: Apr. 20, 2004

Related U.S. Application Data

(60) Provisional application No. 60/464,276, filed on Apr. 21, 2003.

(51) Int. Cl.
*B21C 37/30* (2006.01)
*B24B 1/00* (2006.01)

(52) U.S. Cl. ..... 29/90.01; 451/61

(58) Field of Classification Search ..... 29/90.01, 29/90.3; 451/61, 76, 78, 81, 178, 312, 340, 451/344

See application file for complete search history.

(56) References Cited

U.S. PATENT DOCUMENTS 3,797,055 A * 3/1974 Greene ..... 7/138
5,899,796 A * 5/1999 Kamiyama et al. ..... 451/61
6,935,821 B1 * 8/2005 Bodin et al. ..... 411/29

OTHER PUBLICATIONS

Costs Plus Tools, Marietta, GA, KD Tools Light Bulb Socket Cleaning Brush (Product #KDT139), toolman@costplustools.com, Mar. 30, 2004.

* cited by examiner

*Primary Examiner*—John C. Hong
(74) *Attorney, Agent, or Firm*—Jim Zegeer

(57) ABSTRACT

The light bulb socket burnishing tool is a device used to remove surface corrosion from the interior of common light bulb sockets without their removal from a base, restoring to operation and extending the life of the socket.

5 Claims, 2 Drawing Sheets

LIGHT BULB SOCKET BURNISHING TOOL

REFERENCE TO RELATED APPLICATION

The present application is the subject of provisional application No. 60/464,276 filed Apr. 21, 2003 entitled LIGHT BULB SOCKET BURNISHING TOOL for which priority is claimed.

BACKGROUND AND BRIEF DESCRIPTION OF THE INVENTION

Public, private and commercial use of light bulbs (outside of halogen light bulbs and special purpose light bulbs) consists mostly of "standard" light bulbs, all with common features and construction, using one of three standard bases:

1. The Edison base.
2. The intermediate base.
3. The "candelabra" base.

Such light bulbs consist of three major elements:

1. A glass bulb of some shape, gas-filled and containing a filament to produce light when electricity is applied.
2. A "base" (in one of the three forms listed above) which is a conductive metal cylinder lining the outside circumference of the base, with screw-like threads. This threaded cylinder is typically made of aluminum or brass.
3. In the center of the light bulb base there is a small circular and cone-shaped or rounded contact point. This conductive point provides an electrical path through the filament to the threaded base.

A light bulb socket is designed to accommodate a light bulb, and also consists of three major elements:

1. An outside framework, typically cylindrical in form, and made of plastic or other non-conductive material.
2. A conductive metal cylinder lining the inside circumference of the outside framework, with screw-like threads matching those of the size light bulb which is to be inserted therein. Herein, this will be referred to as the "socket base". This conductive cylinder has an electrical path terminating in one wire of the pair feeding the light fixture. This cylinder is typically made of copper, aluminum or brass, which are subject to corrosion.
3. At the very base and in the center of the light bulb socket there is a small circular and cone-shaped or rounded contact point, which will be referred to herein as the "socket pin". This conductive point has an electrical path terminating in the other wire of the pair feeding the light fixture.

All light bulb sockets are degraded over time by environmental conditions; particularly those exposed directly to uncontrolled environments such as outside light fixtures. Industrial environments in particular may have above average corrosive properties.

The socket base element of the socket is subject to corrosion from oxidation, age, use and the environment. Oxidation on the contact surfaces can cause resistance which causes heat, which causes further oxidation, arcing and heat; and the cycle can repeat leading to detrimental operation of the socket. The small resistance can cause a voltage drop which causes a dimming of the light output. Replacement with new bulbs will not improve the light output significantly because the resistance caused by oxidation is still there.

The socket pin element of the socket is subject to those same factors, plus a "spot welding" effect which may result from a bulb not being fully seated and in complete contact.

This can happen from improper initial insertion or from vibration over time. Such a condition is typically noticeable visually by a low-frequency variation in light output from the bulb, and it may even emit a slightly audible noise. There is a sparking effect, leading to heat buildup on the socket pin element and pits in that element, and perhaps a blackened or corroded status.

Either or both problems may eventually progress to a state where the operation of a bulb becomes intermittent or ceases. When this condition is present, it requires total replacement of the light bulb socket, including rewiring to the new socket, or extremely resourceful attempts to clean the metal components of the old socket, typically without great success.

The object of this invention is to provide a burnishing tool for cleaning the electrical contacting surfaces of a light bulb socket.

BRIEF DESCRIPTION OF THE INVENTION

This invention provides a tool which burnishes the surfaces of the two conductive elements (the base and the pin) of a light bulb socket sufficiently to either extend the life of that socket or make unnecessary its eventual replacement.

The invention features a light bulb socket burnishing tool comprising a cylindrically shaped tool base having an outer surface and upper and lower ends, a handle member extending from the upper end of the tool base, an abrasive carried on the outer surface and an abrasive button carried on the lower end of the tool base. Further, in one embodiment, the tool has a hollow axial passage therein and a rotary shaft is mounted in the hollow passage. The shaft has a first end which extends beyond said lower end of the tool base and a second end which extends beyond the end of the handle. The second end is graspable for rotation. The abrasive button is mounted on the first end of the rotary shaft. Further, the tool handle has a predetermined non-round configuration and includes a pole member having a non-round socket end complementary in shape to the shape of the tool handle for receiving the tool handle and serving as an extension thereof.

BRIEF DESCRIPTION OF THE DRAWINGS

The above and other objects, advantages and features of the invention will become more clear when considered in conjunction with the accompanying drawings wherein.

DETAILED DESCRIPTION OF THE INVENTION

Figure 1:
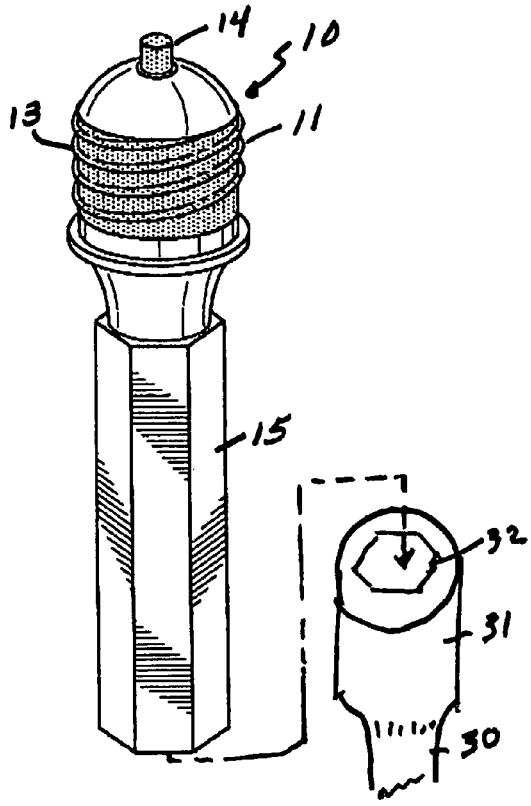
FIG. 1 is an isometric-view of an electric light socket burnishing tool incorporating the invention.
Figure 2:
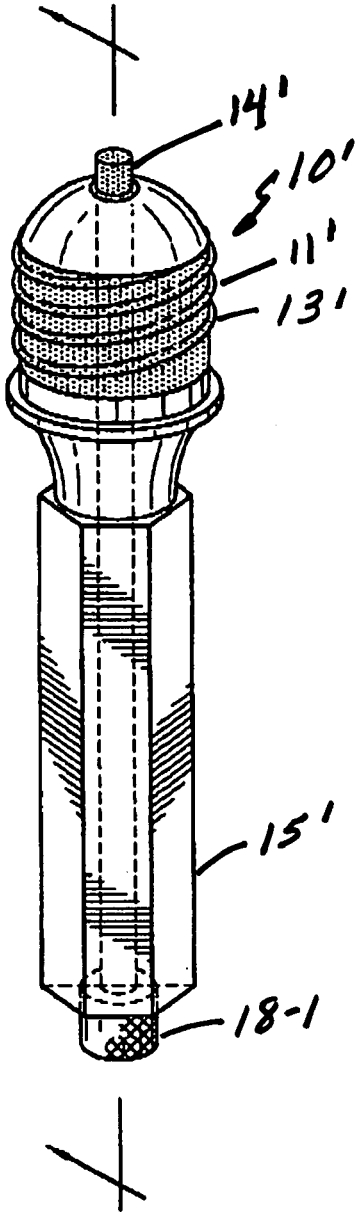
FIG. 2 is an isometric view of a preferred embodiment.

The invention disclosed in FIGS. 1 and 2 embodies three basic elements, and different versions will exist for each of at least the three common light bulb configurations:

A non-conductive cylinder 10 with screw-like threads 11 of form and size equivalent to those of a light bulb base. This cylinder 10 is of approximately the same size as the base of a light bulb, and will be referred to herein as the "tool base" 10.

a. The screw-like threads 11 are coated with abrasive grit 13 suitable for burnishing the metal surfaces of the inside of the light bulb socket. (LS, FIG. 4.)

b. Alternatively, the tool base 10 may be cast of a plastic material with the abrasive grit imbedded in the casting material.

In the center 14 and on the end that makes contact with the pin or spring contact of the light bulb socket (FIG. 4), is a small (approximately the size of a pencil eraser) cylinder-like pin 14 of rubber or similar material, fabricated with a high content of abrasive grit. It is intended that this surface make early contact with the pin 14 of the light bulb socket and burnish that object in the process of being rotated as the tool is screwed into the light bulb socket LS in the same manner that a light bulb might be. The pin 14 will either be flexible enough to make early and continuous contact with the surface of the socket pin, or be spring-mounted to accomplish that purpose.

Because the tool base 10 and the pin 14 of this tool are small, it might prove difficult to use manually in a fully assembled light fixture such as an outside fixture. Therefore the third element of this tool is a screwdriver-like handle 15 affixed to the outside end of the base, so as to add length to facilitate reaching into the depths of an assembled fixture and the repeated rotation of the tool to fully seat the base in the socket, withdraw it, and repeat until the surfaces are properly burnished and operation is restored.

Figure 3:
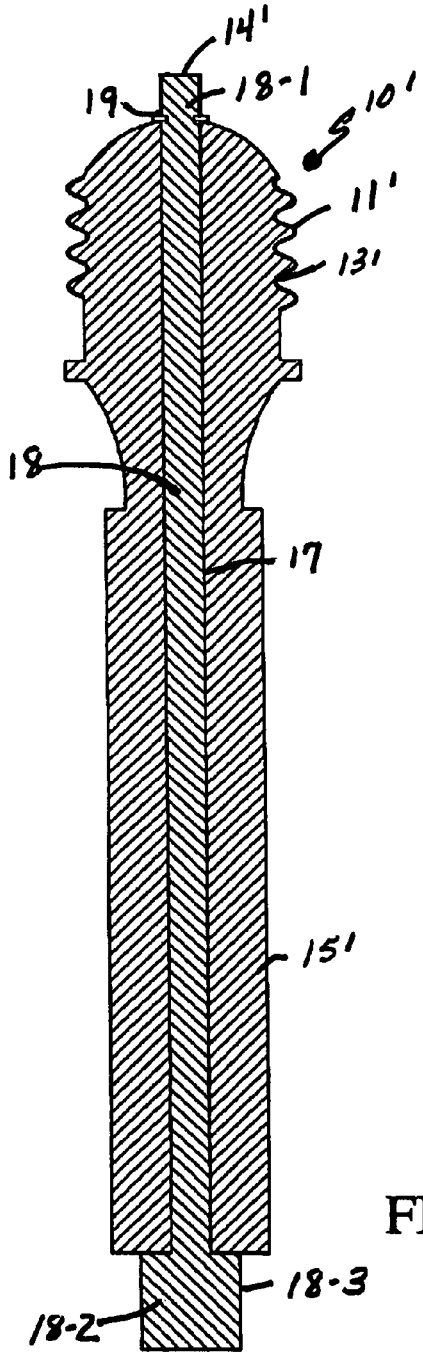
FIG. 3 is a sectional view of the embodiment shown in FIG. 2.
Figure 4:
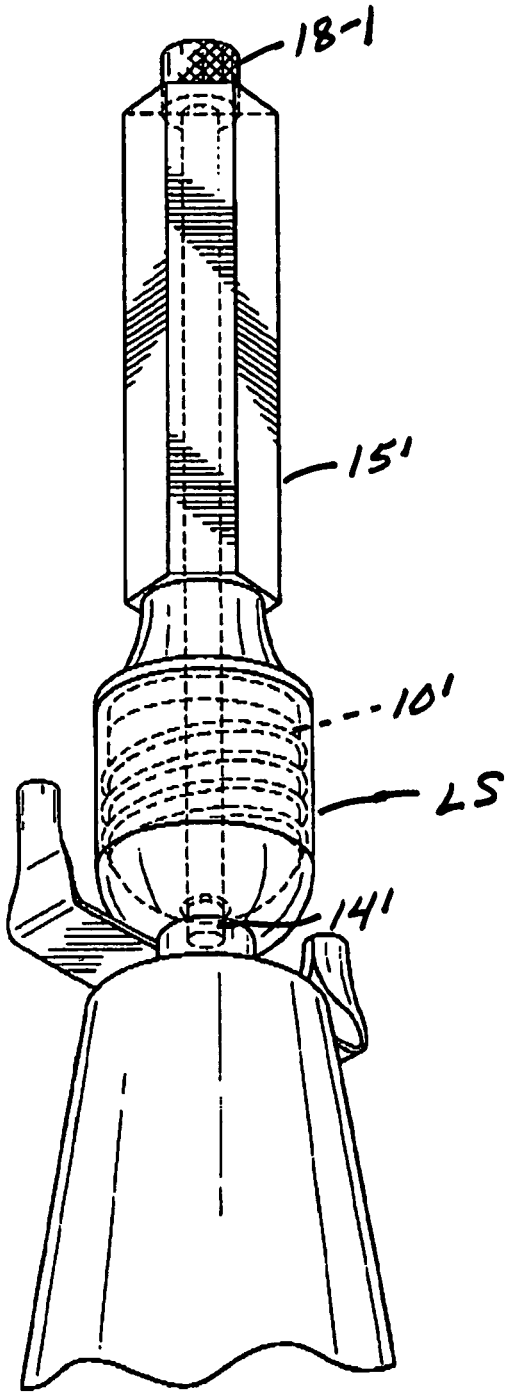
FIG. 4 is an isometric view showing the burnishing tool of FIG. 2 in use in cleaning an ordinary table lamp light bulb socket.

The embodiment shown in FIGS. 2, 3 and 4 incorporates an axial passage 17 carrying a rotary shaft 18. (Corresponding FIG. 1 components have primed numerals.) The rotary shaft 18 has a first end 18-1 which extends beyond the lower end of the tool base 10 and is secured therein by a clip 19. The opposite end 18-2 includes an enlargement 18-3 which is graspable for rotation between the thumb and forefinger so that the abrasive button 14' mounted at the lower end of the rotary shaft burnishes the contact button at the base of the lamp socket. The small knurled knob 18-3 at the rear of the tool and centered, connected directly to the pin 14 on the inside end by a direct shaft linkage 18 linkage so as to rotate the pin 14 independently from the portion that burnishes the socket base. Corrosion on the socket pin tends to build up faster than that on the socket base, and this would allow independent burnishing action against the socket pin. (See FIG. 2.)

Referring again to FIG. 1, there are instances where the light bulb base fixture may be high above the head. For this purpose, the handle 15 is made in a hexagonal or non-round shape. An end of a pole 30 has a socket 31 which is of an hexagonal or non-round shape 32 complementary to the shape of the handle 15 so that the handle 15 fits into the socket 31 so that the user can reach the above or overhead light socket. The pole 30 is preferably of an adjustable length type so that it may be adjusted to a different length or height of the light fixture above the floor where the maintenance person is standing.

While the materials for which the burnishing tool of this invention or construction are non-conductive, it should be appreciated that in all instances, electric power to the lamp should be unplugged and/or the light socket switch turned off when performing the cleaning or burnishing operation using this invention.

While the tool base surface has a screw configuration, it will be appreciated that a non-threaded abrasive surface may be used. In such case, only the socket thread crests would be burnished.

While the invention has been described in relation to preferred embodiments of the invention, it will be appreciated that other embodiments, adaptations and modifications of the invention will be apparent to those skilled in the art.

What is claimed is:

1. A light bulb socket burnishing tool for removing corrosion from metal contacts of a light bulb and improving the electrical performance thereof comprising a cylindrically shaped tool base having an outer surface and upper and lower ends, a handle member extending from said upper end of said tool base, an abrasive carried on said outer surface, an abrasive button carried on said lower end of said tool base and wherein said handle member has a hollow axial passage therein and a rotary shaft is mounted in said hollow passage, said shaft having a first end which extends beyond said lower end of said tool base and a second end which extends beyond the end of said handle member, said second end being graspable for rotation, said abrasive button being mounted on said first end of said rotary shaft.

2. The tool handle defined in claim 1 wherein said handle member and said tool base are made of non-conductive materials.

3. A tool for burnishing the metal parts of a light bulb socket having a conductive metal cylinder and a centrally located conductive metal contact point, said tool comprising a cylindrically shaped tool base having a first and an outer end, an outer surface with a diameter that is complementary to said conductive metal cylinder, a handle member extending from said first end of said shaped tool base and a burnishing material carried on said outer surface, a burnishing material button carried on said outer end of said tool base for burnishing said conductive metal contact point, and wherein said handle member has a hollow axial passage therein, a rotary shaft mounted in said hollow passage, said rotary shaft having an end which extends beyond said lower end of said tool base and constitute said outer end and a second end which extends beyond the end of said handle member, said second end being graspable for rotation, said burnishing material button being mounted on said outer end of said rotary shaft.

4. A tool for burnishing the metal parts of a light bulb socket having a conductive metal cylinder and a centrally located conductive metal contact point, said tool comprising a cylindrically shaped tool base having a first and an outer end, an outer surface with a diameter that is complementary to said conductive metal cylinder, a handle member extending from said first end of said shaped tool base and a burnishing material carried on said outer surface and a burnishing material button carried on said outer end of said tool base for burnishing said conductive metal contact point and wherein said tool base has an outer surface of screw-like threads that are coated with said burnishing material for burnishing said conductive metal cylinder.

5. A light bulb socket burnishing tool for removing corrosion from metal contacts of a light bulb and improving the electrical performance thereof comprising a cylindrically shaped tool base having an outer surface and upper and lower ends, a handle member extending from said upper end of said tool base, an abrasive carried on said outer surface, an abrasive button carried on said lower end of said tool base, and wherein said tool base has an outer surface of screw-like threads which are coated with an abrasive.

* * * * *